United States Patent [19]

Baldridge

[11] Patent Number: 5,040,603

[45] Date of Patent: Aug. 20, 1991

[54] SEQUENTIAL REMOTE CONTROL PLUG RELEASE SYSTEM

[75] Inventor: Morris G. Baldridge, Duncan, Okla.

[73] Assignee: Halliburton Company, Duncan, Okla.

[21] Appl. No.: 516,638

[22] Filed: Apr. 30, 1990

[51] Int. Cl.[5] ..... E21B 33/16

[52] U.S. Cl. ..... 166/291; 166/53; 166/70; 166/153; 166/250

[58] Field of Search ..... 166/53, 113, 291, 64, 166/70, 75.1, 153-156, 250, 255; 137/268, 553

[56] References Cited

U.S. PATENT DOCUMENTS

| | | | |
|---|---|---|---|
| 2,615,519 | 10/1952 | Carr | 166/70 |
| 2,620,037 | 12/1952 | McClendon | 166/70 |
| 3,322,197 | 5/1967 | Baker et al. | 166/75 |
| 3,971,436 | 7/1976 | Lee | 166/70 |
| 4,427,065 | 1/1984 | Watson | 166/250 |
| 4,674,573 | 6/1987 | Bode | 166/291 |
| 4,782,894 | 11/1988 | LaFleur | 166/70 |

OTHER PUBLICATIONS

LaFleur Petroleum Services Brochure Which Begins "Now . . . A Safe, Sure and Proven Cementing Head That Permits Positive Plug Drop With Continuous Cement Flow.", Believed To Be Published More Than One Year Prior To Apr. 27, 1990.

LaFleur Petroleum Services Brochure With Front Page Containing The Word "Fasdrop", Believed To Be Published More Than One Year Prior To Apr. 27, 1990.

Halliburton Company Technical Data Sheet C-1152, "Remote Control For Release Of Cementing Plug" dated Nov., 1965.

*Primary Examiner*—Bruce M. Kisliuk

*Attorney, Agent, or Firm*—James R. Duzan; E. Harrison Gilbert, III

[57] ABSTRACT

A sequential remote control plug release system allows actuation of plug release plungers and manifold valves associated with a cementing plug container only in a predetermined sequence. With regard to a plug container having two plugs, and thus two plug release plungers, and three manifold valves, the middle and upper manifold valves and the upper plug release plunger can be opened and retracted only in a predetermined sequence. This is implemented through interconnected actuation valves and sequencing valves contained in a housing which can be located remotely from the plug container. An improvement in plug release plungers is also disclosed.

16 Claims, 5 Drawing Sheets

SEQUENTIAL REMOTE CONTROL PLUG RELEASE SYSTEM

BACKGROUND OF THE INVENTION

The present invention relates generally to apparatus and methods for preventing two or more plugs in a plug container from being released from the container into a well except in a predetermined sequence. The present invention relates more particularly, but not by way of limitation, to an apparatus and a method for controlling the use of a plug container connected to a well during a cementing job, which plug container includes two stacked plugs and two fluid inlet valves which are to be sequenced to the release of the two plugs.

During cementing of wells, a bottom plug is inserted into the casing ahead of the cement slurry and is pumped down the casing. A top plug is then inserted in the casing on top of the cement. The top plug separates the cement from the drilling mud or fluid which is used to force the cement out through the bottom of the casing and up through the annular space between the hole and the casing. It is important that the plugs be released at the proper time during the cementing process so that they separate the cement slurry from the drilling mud or fluid. Cementing plugs are usually stored in a plug container on top of the casing at the well head. A bar or other means supports a plug in the plug container until the appropriate time for releasing the plug. The bar is then removed, thereby allowing the plug to drop into the casing. Various levers and rods have been proposed for temporarily retaining a plug in the plug container.

A particular embodiment of a plug container includes two plugs, held by two plug release plungers, and three fluid inlets, connected through manifold valves to a manifold through which the cement and drilling mud or fluids are pumped. The plug release plungers and the manifold valves must be operated to release the plugs and admit the fluids at the proper times. They can be manually operated by an operator at the plug container, or more preferably they can be operated remotely from the well head where the container is attached. Improved safety, enhanced convenience, and automated control "on the fly" are some of the reasons why remote control is preferred.

In either local or remote control, the operator could release an upper plug before a lower plug has been released and the operator could open a fluid inlet valve before a lower plug has been dropped. Either of these situations can be hazardous or can cause an improper cementing job to result. Therefore, there is the need for an automatic sequencing controller which prevents an operator from releasing the wrong plug or opening the wrong inlet valve during the cementing job. Although there is the need for such sequence control, there is also the need to permit the closure of any manifold valve at any time so that they can be shut down in an emergency, for example. Opening and closing the manifold valves in any order once a cementing job has been completed is also desirable so that the fluid inlet system can be readily cleaned, for example.

SUMMARY OF THE INVENTION

The present invention meets the aforementioned needs by providing a sequential remote control plug release system. The system allows activation of plug release plungers and manifold valves from a remote location, such as from the rig floor. Sequencing is provided to prevent the operator from accidentally releasing an upper plug before a lower plug or from opening the wrong manifold valve. The present invention is particularly suitable when stacking single plug containers or using double plug containers having two plungers and three manifold valves; however, the present invention can be adapted for use with other plug container configurations.

The remote control feature of the present invention enables the operator to control the plug release and fluid inlet functions from a safer environment than immediately at the well head where the plug container is located.

In its preferred embodiment, the system allows the manifold valves to be closed at any time, such as if an emergency arises; and once the predetermined sequence has been followed, the manifold valves can be opened and closed in any order to facilitate cleaning, for example.

In a preferred embodiment, fluid pressure conducting hoses which connect the plug container to the remote location can be bundled in groups of two or four hoses, for example, and have end connectors of different sizes and separations keyed to prevent improper make up of the system.

The present invention provides an apparatus for preventing two plugs in a plug container from being released from the container except in a predetermined sequence. This apparatus comprises: first release means for activating, at a first selected time, the release of the plug predetermined to be released first; second release means for activating the release of the other plug at a second selected time; and sequencing means, connected to said first and second release means, for disabling the second release means from activating the release of the other plug unless the second selected time is after the first selected time. In a preferred embodiment, the apparatus further comprises manifold valve actuating means for actuating a manifold valve connected to the plug container; and the sequencing means includes: a first valve, including a first valve actuation port connected to the first release means, and a first valve inlet port connected to the manifold valve actuating means, and a first valve outlet port, wherein the first valve is responsive to the first release means so that the first valve inlet port communicates with the first valve outlet port only after the first selected time; and a second valve, including a second valve actuation port connected to the first valve outlet port, and a second valve inlet port connected to the second release means, and a second valve outlet port, wherein the second valve is responsive to the manifold valve actuating means through the first valve so that the second valve inlet port communicates with the second valve outlet port only after both the first selected time and a time at which the manifold valve actuating means opens the manifold valve. In a predetermined embodiment, the sequencing means further includes a check valve including an inlet connected to the first valve outlet port, and an outlet connected to the first valve inlet port.

The present invention also provides a method for controlling the use of a plug container connected to a well during a cementing job, which plug container includes two stacked plugs and two fluid inlet valves. The method comprises: releasing the lower plug into the well; completing a first control signal circuit in response to releasing the lower plug into the well; opening one of the two fluid inlet valves, including sending a control signal through the completed first control signal circuit; completing a second control signal circuit in response to sending a control signal through the completed first control signal circuit; releasing the upper plug into the well, including sending a control signal through the completed second control signal circuit; completing a third control signal circuit in response to sending a control signal through the completed second control signal circuit; and opening the other fluid inlet valve, including sending a control signal through the completed third control signal circuit. In a preferred embodiment the method further comprises maintaining completed control signal circuits through which control signals for closing the fluid inlet valves can be sent at any time.

Therefore, from the foregoing, it is a general object of the present invention to provide a novel and improved sequential remote control plug release system. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is a schematic circuit diagram of actuating valves and sequencing valves contained within the remote console shown in FIGS. 3 and 4.

DETAILED DESCRIPTION OF PREFERRED EMBODIMENTS

Figure 1:
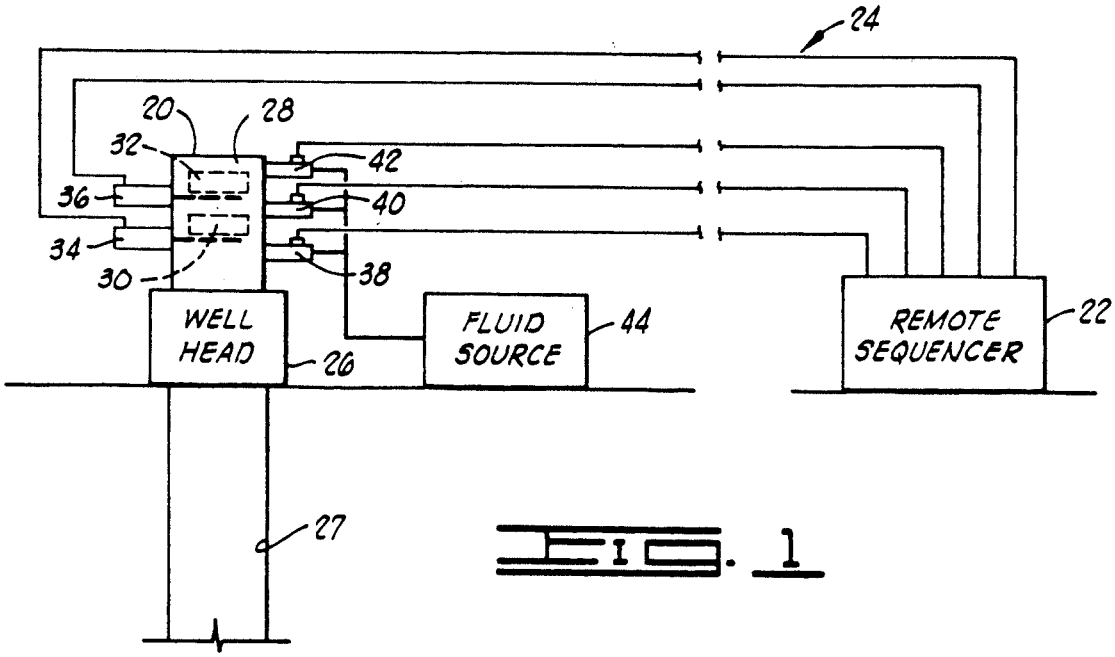
FIG. 1 is a block diagram of a system of the present invention located at a well site.

Referring to FIG. 1, a sequential remote control plug release system of the present invention includes a plug container 20 connected to a remote sequencer 22 by control signal conductors 24. The plug container 20 is connected in a known manner to well head equipment 26 at the mouth of a well 27. The remote sequencer 22 is at a location remote from the well, such as on the floor of a rig above the well head.

As represented in FIG. 1, the plug container 20 of a particular embodiment includes a chamber 28 for receiving two conventional cementing plugs, such as a lower five-wiper plug 30 and an upper top plug 32. A plug release plunger 34 is connected to the plug container 20 in a known manner so that the plug release plunger 34 can be extended into the chamber 28 to support the lower cementing plug 30 and further so that the plug release plunger 34 can be retracted out of the chamber 28 to allow the cementing plug 30 to drop into the well 27. A plug release plunger 36 is connected to the plug container 20 above the plug release plunger 34 so that the plug release plunger 36 can be extended into the chamber 28 to support the upper cementing plug 32 and further so that the plug release plunger 36 can be retracted out of the chamber 28 to allow the upper cementing plug to drop into the well 27.

The plug container 20 depicted in FIG. 1 also includes three fluid inlets to which three manifold valves, modified with actuators, 38, 40, 42 are connected. The manifold valve 38 is connected to the plug container 20 below the plug release plunger 34; the manifold valve 40 is connected to the plug container 20 in between the two plug release plungers 34, 36; and the manifold valve 42 is connected to the plug container 20 above the plug release plunger 36 as illustrated in FIG. 1. The valves 38, 40, 42 are manifolded and connected to a fluid source 44 which in the specific implementation referred to herein provides cement slurry, drilling mud and other fluids used in a cementing job where something, such as a casing, is to be cemented into the well 27. Specific types of valves 38, 40, 42, including actuators, used in the preferred embodiments described herein are LO TORQ plug valves with actuators which can deliver 5000 inch-pounds of torque with 125 psi air pressure. These have manual override capability which can be locally operated if needed.

The plug release plungers 34, 36 are designed to lock mechanically in their extended positions to help prevent internal pressure from the well from retracting the plungers. The mechanical lock releases when actuating pressure is supplied to retract the respective plug release plunger. The plug release plungers may be operated manually if the actuating pressure supply fails. By retracting a locking sleeve using manual override handles which are provided, the operator frees the plunger so that it can be retracted from the chamber 28. The locking sleeve is spring-loaded and must be retracted fully to release the plunger in the preferred embodiment.

The preferred embodiment of the plug release plungers 34, 36 is similar to the type of plug release plunger disclosed in U.S. Pat. No. 3,322,197 to Baker et al. incorporated herein by reference. A general description of a particular embodiment will be described with reference to FIG. 2.

Each plug release plunger 34, 36 of the preferred embodiment includes a body 46 having an open end of a cavity 47 which receives a mandrel 48 having a threaded nipple 50 for screwing into a mating opening of the plug container 20 which has a cylindrical outer sleeve. Slidably disposed within the body 46 and mandrel 48 is a plunger or plug retaining arm 52. The forward end 54 of the arm 52 extends into and retracts from the chamber 28 of the plug container 20. A rearward end 56 of the arm 52 receives an eye bolt 58 which can be grasped and pulled to manually move the retaining arm 52.

Figure 2:
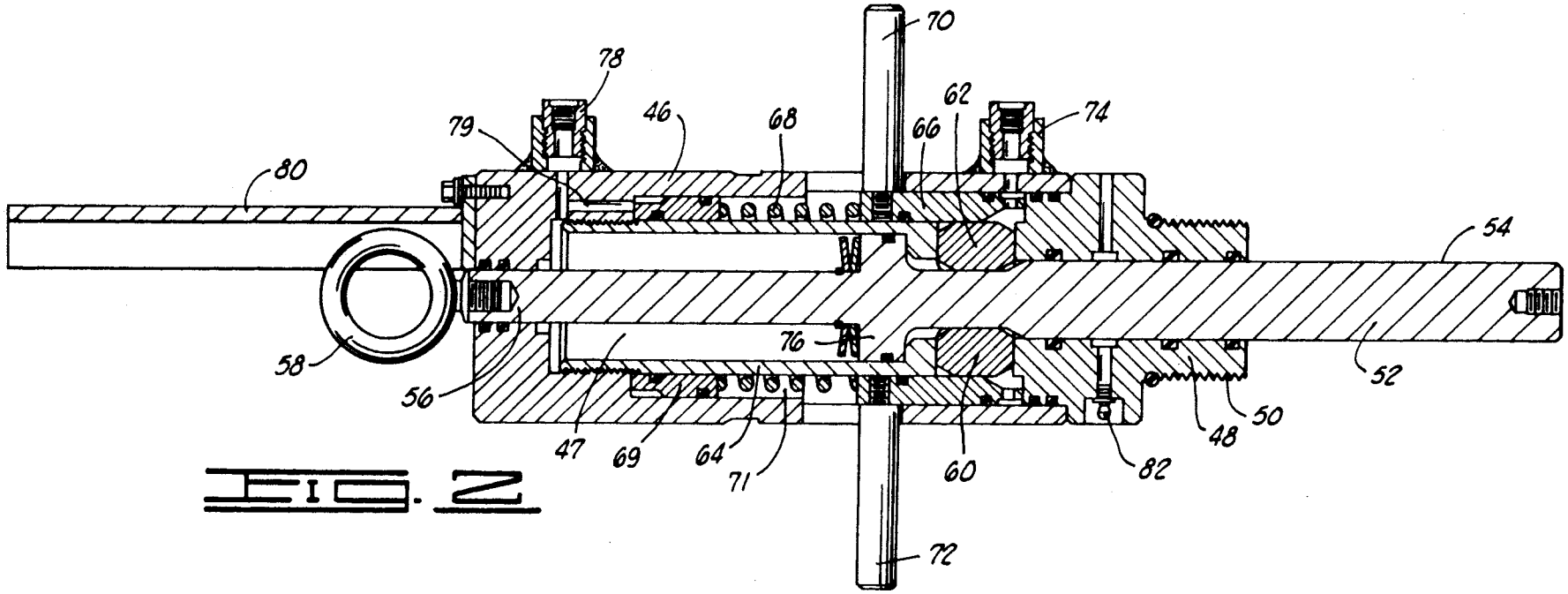
FIG. 2 is a sectional elevational view of a plug release plunger of a preferred embodiment of the present invention.

In its extended position shown in FIG. 2, the retaining arm 52 is locked by locking dogs 60, 62 which are longitudinally retained between an inner support sleeve 64 and the mandrel 48. In the position shown in FIG. 2, the dogs 60, 62 are held or fixed radially in engagement with the retaining arm 52 by a piston 66 biased to a rightward position (as viewed in FIG. 2) by a spring 68. The spring 68 can itself be biased or compressed by an annular piston 69 slidably disposed around the sleeve 64. The piston 69 is received in an annular spring receptacle or cavity 71 defined between the body 46 and the sleeve 64. Handles 70, 72 connect to the piston 66 so that an operator can grasp the handles and retract the piston 66 to release the locking dogs 60, 62 manually if needed.

During normal remote operation, the piston 66 is moved to a leftward position as viewed in FIG. 2 to release or free the locking dogs 60, 62 in response to the application of a pressurized fluid signal received through a port 74. The received pressurized signal also acts against a surface of an enlarged piston portion 76 of the retaining arm 52 to move the retaining arm 52 to the left as viewed in FIG. 2, which retracts the forward end 54 of the retaining arm 52 from the chamber 28 of the plug container 20. When the retaining arm 52 is to be extended into the chamber 28, a pressurized fluid signal is communicated to a port 78 near the rear of the plug release plunger body 46 to act oppositely against the piston 76. A pressurized fluid through the port 78 also acts through a channel 79 on the piston 69 to urge it against the spring 68 for insuring that the locking dog retaining piston 66 holds the locking dogs 60, 62 in place. The channel 79 also communicates with the cavity 47 through the radial passage from port 78.

Also connected at the rear of the body 46 of the plug release plunger is a protective shield 80 which covers the rearward end of the retaining arm 52 when it is retracted.

A grease fitting 82 mounted in a recess of the mandrel 48 allows for lubricating grease to be added as needed.

The remote sequencer 4 provides remote control means, adapted to be operated at a location spaced remotely from the plug container 20, for controlling the retracting of the plug release plungers 34, 36 and the opening of the manifold valves 38, 40, 42. The remote sequencer 4 of the preferred embodiment includes an operator console or control panel 84 having two exterior views shown in FIGS. 3 and 4. The console 84 includes a sequencing apparatus to help prevent activation of a plug release plunger or manifold valve at the wrong time. The operator must follow the correct sequence of releasing plugs and opening manifold valves; otherwise, the console will ignore the operator's actions directed to releasing the plugs or opening the manifold valves. This prevents releasing an upper plug before a lower plug, and it also prevents pumping on top of a plug before it has been released. In the preferred embodiment of the present invention, however, all manifold valves can be closed at any time irrespective of the predetermined sequencing so that the inlet openings of the plug container 20 connected to the manifold can be closed in case trouble arises, for example.

Figure 3:
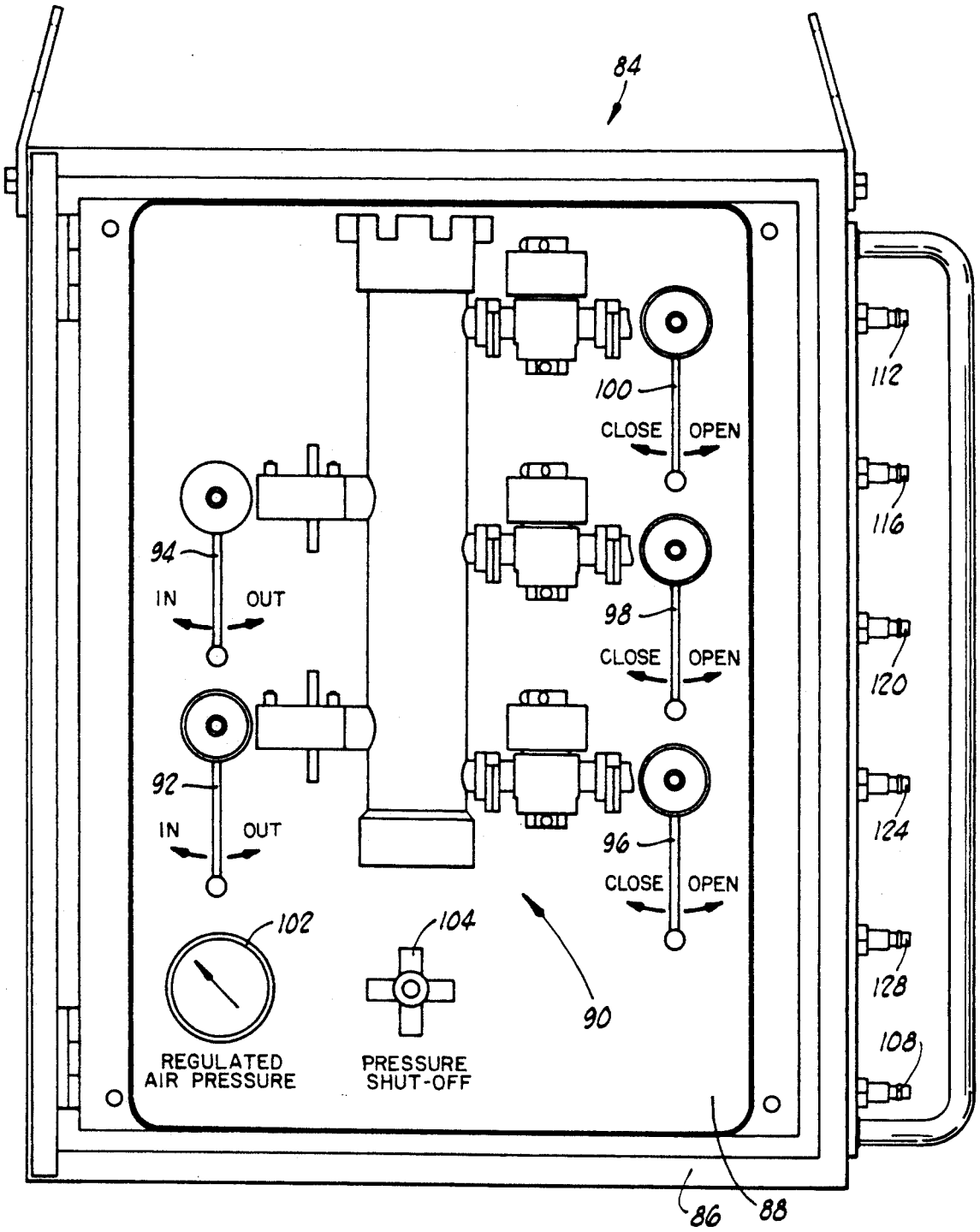
FIG. 3 is an elevational view of a front panel of a remote control console of a preferred embodiment of the present invention.

Referring to FIG. 3, the console 84 includes a stainless steel enclosure or housing 86 with a key-locked panel door (not shown). When closed, the panel door seals to keep out moisture and debris. Opening the door reveals a front panel 88 containing a schematic illustration 90 of the double plug container 20 with the two plug release plungers 34, 36 and the three manifold valves 38, 40, 42. Valve operating handles 92, 94, 96, 98, 100 are positioned beside the schematically represented plug release plungers 34, 36 and manifold valves 38, 40, 42, respectively. The handles 92, 94, 96, 98, 100 connect to actuating valves disposed within the housing 86 as will be further described hereinbelow.

Also associated with the front panel 88 of the housing 86 is a pressure gauge 102 which registers actuating fluid pressure regulated within the console. Also shown in FIG. 3 is a handle 104 which is connected to a subsequently described pressure shut off valve.

Figure 4:
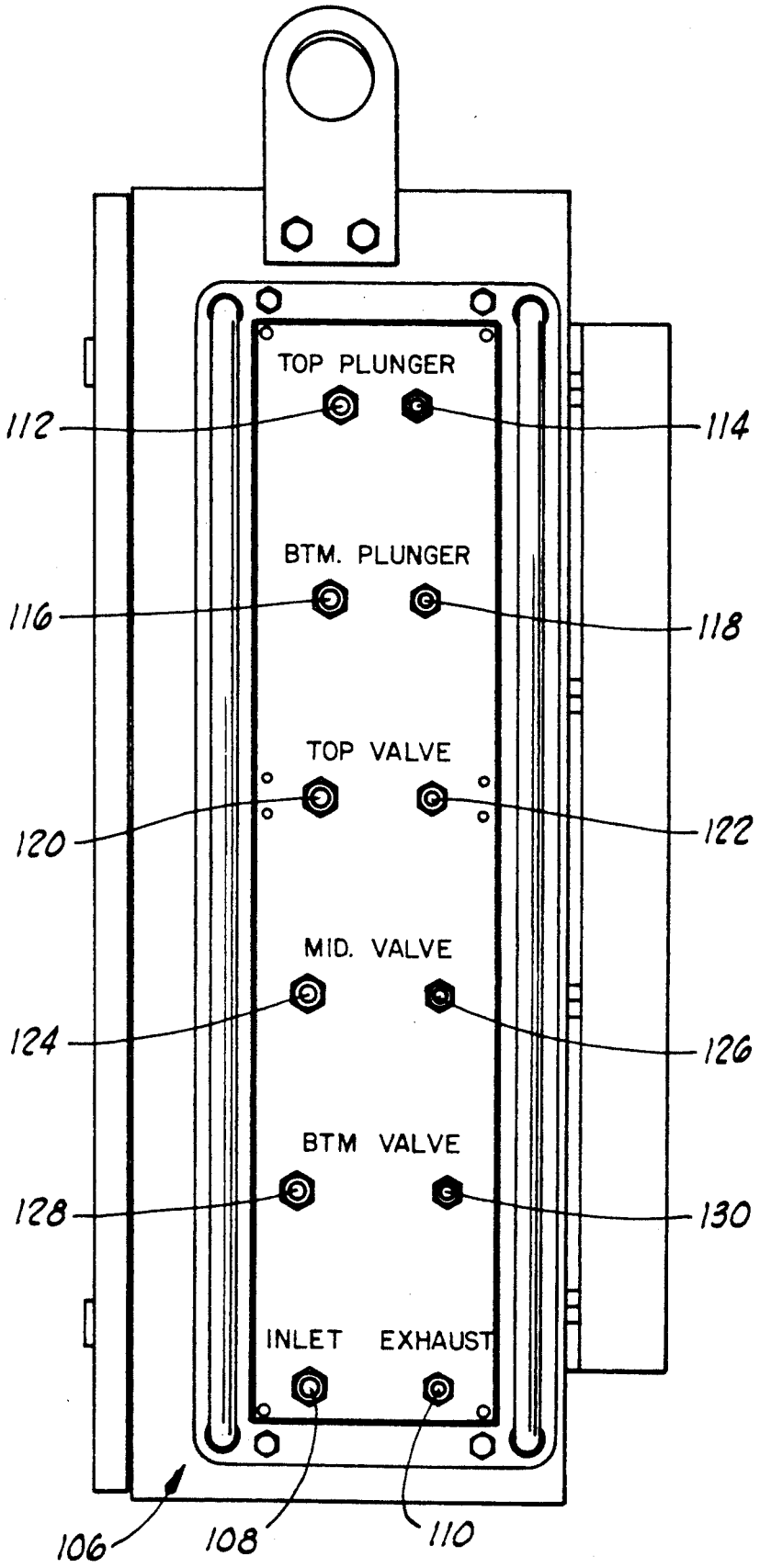
FIG. 4 is an elevational view of a side panel of the remote control console shown in FIG. 3.
Figure 5:
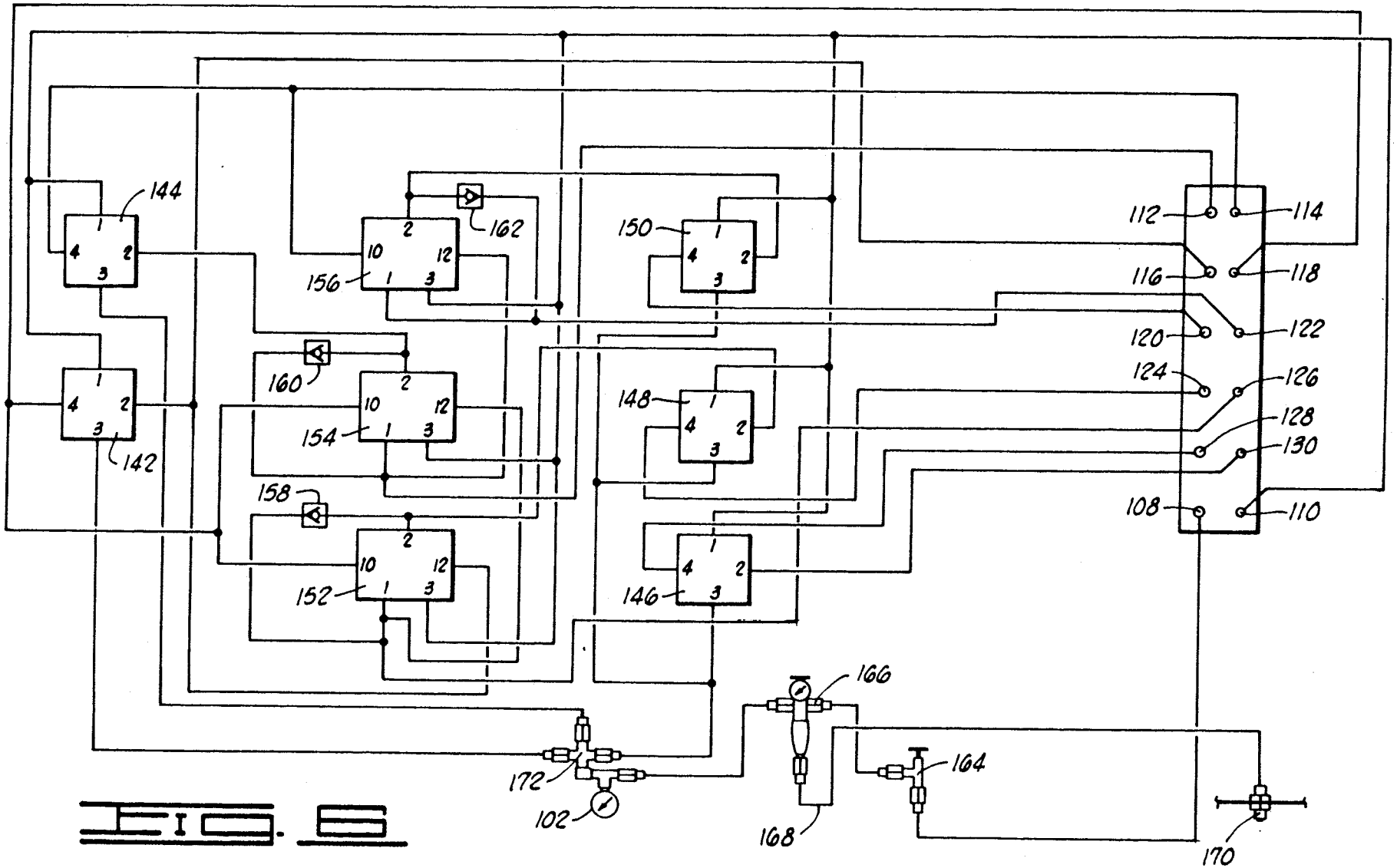

Referring to FIG. 4, a side panel 106 extending perpendicular to the front panel 88 is shown. Six pairs of connectors are mounted through the side panel 106. The internal portions of the connectors connect to portions of the sequencing apparatus contained within the housing 86, and the external portions of the connectors connect to the conductors 24 schematically illustrated in FIG. 1 (except for the lowermost pair of connectors 108, 110, which connector 108 connects to a pressurized fluid source and which connector 110 connects to an exhaust line or simply provides an exhaust port). A pair of connectors 112, 114 are connected through a pair of hoses of the conductors 24 to the ports 74, 78 of the plug release plunger 36; a pair of connectors 116, 118 connect through a respective pair of hoses of the conductors 24 to the ports 74, 78 of the plug release plunger 34; a pair of connectors 120, 122 connect through a respective pair of hoses to the actuator of the top manifold valve 42; a pair of connectors 124, 126 connect through a respective pair of hoses of the conductors 24 to the actuator of the middle manifold valve 40; and a pair of conductors 128, 130 connect through a respective pair of hoses of the conductors 24 to the actuator of the bottom manifold valve 38. As will be noted in FIG. 4, the connectors within each of the pairs of the connectors 112-130 are spaced different distances apart. As shown in FIG. 4, the connectors 112, 114 are the closest, with progressively wider spacing for the subsequent pairs of connectors through the pair of connectors 128, 130. Each of these distances or spacings is different to provide a key which must be matched by a respective pair of hoses of the conductors 24 to facilitate correct connections being made. Thus each respective pair of hoses connected to these pairs of connectors is keyed to the spacing between the respective connectors. Additionally, within each pair of connectors, one connector is larger than the other so that the proper individual hose within a hose pair is connected to the correct connector.

Figure 5:
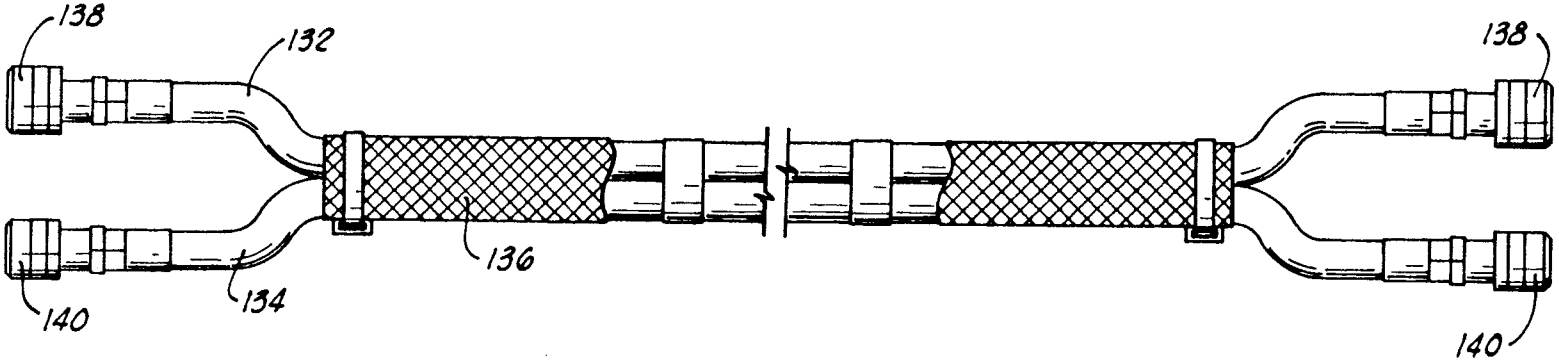
FIG. 5 is a view of a pair of connector hoses for connecting the remote control console to a plug container located at the well site.

An example of a suitable pair of conductor hoses for implementing each of the conductors 24 represented in FIG. 1 and suitable for connecting to the arrangement of connectors shown in FIG. 4 is illustrated in FIG. 5. Each pair includes hoses 132, 134 held together within a nylon sleeve 136. Each pair of ends, however, uses different sizes of couplings. For example a coupling 138 connected to the hose 132 is a ⅜ inch quick disconnect coupler, and a coupler 140 connected to the hose 134 is a ¼ inch quick disconnect coupler. The same type of couplers 138, 140, are used at the other pair of ends of the hoses 132, 134. One pair of these ends would connect to a respective pair of connectors o the side panel 106 and the pair of couplers at the other end of the hose pair would connect to the respective plug release plunger or manifold valve at the plug container 20. The hoses 132, 134 and the sleeve 136 are also designed in the preferred embodiment to space the paired ends of the hoses 132, 134 to match the spacing of the respective connector pairs on the side panel 106 of the console 84. Such a hose pair might have a length of fifty feet or any other suitable length to accommodate how remote the console 84 is to be from the plug container 20. There is a similar pair of hoses for each of the sets of connectors 112-130 of the preferred embodiment. It is through these hose pairs that the various actuating signals are communicated in the proper sequence from the console 84 to the respective plug release plungers and manifold valves at the plug container 20.

Next, the sequencing apparatus contained within the housing 86 will be described with reference to FIG. 6. Connected to the handles 92, 94, 96, 98, 100 (FIG. 4) and mounted inside the housing 86 are four-way actuating valves 142, 144, 146, 148, 150, respectively. Also contained within the housing 86 are sequencing valves 152, 154, 156.

The valves 142, 144 are the valves by which actuating signals are provided to extend or release the plug release plungers 34, 36, respectively. Each of these valves includes an exhaust port (1), a retract port (2), an inlet port (3) and an extend port (4). The handles 92, 94 are used to move the respective valve spools or members either so that ports 1, 4 and ports 2, 3 communicate when the respective plug release plunger is to be retracted or so that ports 1, 2 and ports 3, 4 are connected when the respective plug release plunger is to be extended.

The valves 146, 148, 150 are used to provide actuating signals to the manifold valves 38, 40, 42, respectively. Each of the actuating valves 146, 158, 150 is of the same type as the valves 142, 144 having ports 1, 2, 3, 4; however, whereas ports 1 and 3 of the valves 146, 148, 150 are likewise exhaust and inlet ports, ports 2, 4 of the valves 146, 148, 150 are referred to as open and close ports, respectively, to indicate that the pressurized fluid signals which are output from these respective ports act to either open or close the respective manifold valve based on the connections shown in FIG. 6. The handles 96, 98, 100 move the respective shuttle or valve member of the valves 146, 148, 150 either so that ports 1, 2 and ports 3, 4 are connected to provide a manifold valve closing signal or so that ports 1, 4 and ports 2, 3 are connected to provide an opening signal to the respective manifold valve.

The valves 142, 144, 146, 148, 150 of a specific implementation are Republic 4-way valves with spring return to closed position.

The sequencing valves 152, 154, 156 of the preferred embodiment are Norgren sequence spool valves. Each of the valves 152, 154, 156 includes an outlet port (1), an inlet port (2), an exhaust port (3) and two drive or actuation ports (10, 12).

Also contained within the housing 86 are check valves 158, 160, 162 shown in FIG. 6. The inlet of the check valve 158 is connected to the outlet port of the valve 152, and the outlet of the check valve 158 is connected to the inlet port of the valve 152. The check valves 160, 162 are similarly connected to the outlet and inlet ports of the valves 154, 156, respectively.

Also contained within the housing 86 of the console 84 is a shut off valve 164 to which the control handle 104 on the front panel 88 is connected. This controls the flow or no flow of the pressurizing fluid communicated through the connector 108 of the side panel 106 of the housing 86. In the preferred embodiment, pressurized air is used as the control fluid; however nitrogen or other suitable gas could be used, as well as hydraulic fluid. The preferred embodiment will be described with reference to pressurized air.

Connected to the shut off valve 164 is a combined filter/regulator 166 which regulates the air pressure and filters moisture from the pressurized air. Accumulated liquid is automatically dumped through a dump line 168 and an outlet 170 disposed through the bottom of the housing 86. The regulated air supply flows through the pressure gauge 102 and through an adapter 172 which connects to each of the inlet ports of the valves 142, 144, 146, 148, 150. A specific embodiment of a suitable combined filter/regulator is a Norgren air regulator with automatic water dump.

As mentioned, all of the inlet ports of the valves 142, 144, 146, 148, 150 are connected to the common pressurized air supply through the adapter 172. The exhaust ports of these five valves, and the exhaust ports of the sequencing valves 152, 154, 156, are likewise connected in common, but to the exhaust connector 110 on the side panel 106 of the housing 86.

Still with reference to FIG. 6, the remaining connections of the valves 142–156 will be described. Beginning with the valve 146, which provides the actuating signal for operating the bottom manifold valve 38, the open port 2 connects to the connector 130 on the side panel 106, and the close port 4 connects to the connector 128 on the side panel 106. Thus, operation of the valve 146 by rotating the handle 96 communicates the pressurized actuating air signal, received through the inlet port 3 of the valve 146, directly to the bottom manifold valve 38 without regard to the predetermined sequencing established by the sequencing valves 152, 154, 156.

The actuating valve 142, which provides an actuation signal for controlling the bottom plug release plunger 34, likewise provides its inlet pressurized air signal directly to the bottom plug release plunger 34 through the connectors 116, 118 which are directly connected to the retract port 2 and extend port 4, respectively, of the valve 142. However, the port 2 of the valve 142 is also connected to drive port 12 of the sequencing valve 152, and the port 4 of the valve 142 is also connected to the drive ports 10 of the sequencing valves 152, 154.

The inlet port 2 of the sequencing valve 152 is connected to the open port 2 of the actuating valve 148, which provides the actuation signal for the middle manifold valve 40. The outlet port 1 of the sequencing valve 152 is connected both to the drive port 12 of the sequencing valve 154 and to the connector 126 on the side panel 106 of the housing 86. The paired connector 124 is connected to the close port 4 of the actuating valve 148.

The sequencing valve 154 has its inlet port 2 connected to the retract port 2 of the actuating valve 144, which valve 144 provides an actuating signal for controlling the upper plug release plunger 36 connected through the connectors 112, 114 to the outlet port 1 of the sequencing valve 154 and to the extend port 4 of the actuating valve 144, respectively. The outlet port 1 of the sequencing valve 154 is also connected to the drive port 12 of the sequencing valve 156, which valve 156 has its other drive port 10 connected to the extend port 4 of the actuating valve 144.

The inlet port 2 of the sequencing valve 156 is connected to the open port 2 of the actuating valve 150, which valve 150 provides an actuating signal for controlling the upper manifold valve 42 connected to the connectors 120, 122. The connector 120 is connected to the close port 4 of the actuating valve 150, and the connector 122 is connected to the outlet port 1 of the sequencing valve 156.

Operation

Loading the plugs/resetting the system

For the preferred embodiment of the system described hereinabove, the plugs 30, 32 must be installed in conjunction with controls on the console 84 to activate the sequencing properly. If the sequencing valves are not reset as follows, they will stay in the open position, thereby permitting activation of any of the plug release plungers and manifold valves at any time.

First, the pressurized air supply is attached to the connector 108. To load the bottom cementing plug 30, the valve handle 92 connected to the valve 142 is moved to the "in" (extend) position identified on the console schematic 90. This extends the retaining arm 52 of the lower plug release plunger 34 into the chamber 28. The lower plug 30 is then lowered through the top of the plug container in a known manner. The same procedure is then followed for the upper plug release plunger 36 and the upper plug 32 using the control handle 94 connected to the valve 144.

Upon loading the cementing plugs, all three manifold valves are closed by rotating the respective control handles 96, 98, 100, connected to the valves 146, 148, 150, respectively, to the "closed" position. This completes the loading/resetting of the system, after which the control pressure supplied to the console can be shut off using the valve 164 and the attached handle 104 and disconnecting the air supply from the connector 108 if des red.

Conducting a cement job

Assuming the system has been loaded and reset as described above, the following method can be performed. Initially, the pressurizing air supply is connected to the connector 108 and the shut off valve 164 opened if not already done.

To Circulate the well, the control handle 96 is moved to the "open" position which opens the lower manifold valve 38. Referring to FIG. 6, this movement of the handle 96 communicates the pressurized air from the port 3 to the port 2 of the valve 146 and it exhausts air from this circuit from the port 4 to the port 1 of the valve 146. The handle 96 is maintained in the "open" position until all the air has exhausted through the valve 146.

To release the bottom cementing plug 30, the handle 92 is moved to the "out" (retract) position. Referring to FIG. 6, this pressurizes the retract port 2 and exhausts the port 4 of the valve 142. This causes the retaining arm of the lower plug release plunger 34 to be retracted. This also provides the pressurizing signal to the drive port 12 of the sequencing valve 152 and exhausts the drive port 10 thereof. This moves the shuttle of the valve 152 so that the inlet port 2 and the outlet port 1 communicate to complete a control signal circuit associated with the actuation valve 148. To accomplish these results, the handle 92 is maintained in the "out" position until all the air has exhausted. Thus, the sequencing valve 152 completes the control signal circuit for the valve 148 in response to releasing the lower plug 30 using the valve 142.

To open the middle manifold valve 40 and pump cement through it, the valve 148 is operated by moving the connected control handle 98 to the "open" position. This communicates the port 3 with the port 2 of the valve 148 which in turn communicates the pressurized actuating signal to the inlet port 2 of the sequencing valve 152 which has been connected to the outlet port 1 thereof as just described. This operates the actuator of the middle manifold valve 40, which has its internal air exhausted through the connected ports 4, 1 of the valve 148. If the control handle 98 is moved to its "open" position before the bottom plug 30 has been released, and thus prior to the completion of the control circuit through the sequencing valve 152, the pressurized air signal from the port 2 of the valve 148 will simply be exhausted through port 3 of the sequencing valve 152 so that the middle manifold valve 40 will remain closed.

Completion of the circuit between the ports 2 and 1 of the sequencing valve 152 not only allows the pressurized air signal from the valve 148 to operate the middle manifold valve 40, but also it communicates the pressurized air signal to the drive port 12 of the sequencing valve 154 to move its internal shuttle to connect the valve 154 ports 2 and 1 thereby completing a control signal circuit associated with the actuation valve 144. This allows the upper cementing plug 32 to be released when the control handle 94 connected to the valve 144 is moved to the "out" (retract) position. When the control handle 94 is so moved, the pressurized air signal flows from the inlet port 3 to the retract port 2 of the valve 144 and on through the completed circuit through the sequencing valve 154 to the connector 112. The return from the connected upper plug release plunger 36 comes through the connector 114 and exhausts through the connected ports 4, 1 of the valve 144. As with the other actuation valves, the control handle 94 is held in the operating position until all the air is exhausted. If the control handle 94 is prematurely moved before the sequencing valve 154 has been set to complete the control signal circuit, pressurized air communicated from the port 3 to the port 2 of the valve 144 will be exhausted through the port 3 of the valve 154.

When the circuit is completed between the ports 2, 1 of the sequencing valve 154 and the upper plug 32 is released by operating the valve 144, the pressurized signal communicated through the valve 144 to achieve this also drives the shuttle of the sequencing valve 156, via the drive port 112 thereof, to communicate the inlet port 2 with the outlet port 1 and thereby complete a control signal circuit associated with the valve 150 through which a control signal is provided for operating the upper manifold valve 42. To open the manifold valve 42, the handle 100 connected to the valve 150 is moved to its "open" position. This communicates the pressurized air signal from the port 3 to the port 2 of the valve 150 which in turn is communicated through the connected ports 2, 1 of the sequencing valve 156 and through the connector 122 to the actuator of the manifold valve 42. The exhaust portion of the circuit in which the actuator of the valve 42 is connected comes through the connector 120 and the connected ports 4, 1 of the valve 150. The handle 100 is maintained in its "open" position until all the air in the completed control circuit has been exhausted.

Typically, when the middle manifold valve 40 is to be opened, the lower manifold valve 38 will be closed, and when the upper manifold valve 42 is opened, the middle manifold valve 40 will be closed. Closure of any of the manifold valves 38, 40, 42 is accomplished by moving the respective control handle 96, 98, 100 to its "closed" position. This reverses the direction that the pressurized air signal is provided in the respective control circuit. It is to be noted that the application of the control signal in this reversed direction always causes closure of the manifold valve regardless of the state of the sequencing valves 152, 154, 156. This is possible because of the direct connections to the manifold valve 38 with respect to the valve 146 and because of the check valves 158, 162 with respect to the circuits of the control valves 148, 150. Likewise, the plug release plungers can always be extended regardless of the state of the sequencing valves 152, 154, 156 because of the direct connections of the valve 142 to its plug release plunger 34 and because of the check valve 160 in the control circuit which includes the valve 144. Thus, the reverse flow circuits for providing close or extend actuation signals are always completed.

Once the sequencing valves 152, 154, 156 have been set to complete the respective control circuits via communication of the respective inlet ports 2 and outlet ports 1 of the sequencing valves, the plug release plungers and manifold valves can be retracted and opened in any order. This makes it convenient for cleaning the manifold, for example, after the cementing job has been completed. Once the valves 142, 144 have been operated to the "in" or extend position, however, the sequencing valves are reset. This will prevent opening the middle or upper manifold valves 40, 42 until the respective sequencing valves are again opened.

Thus, the sequencing valves 152, 154, 156 as connected in FIG. 6 provide sequencing means for preventing an actuating signal for the manifold valve 40 from opening the valve 40 through the respective conductor means until after the actuating signal for the plug release plunger 34 is provided through its respective conductor means to retract the plug release plunger 34, and for preventing the actuating signal for the plug release plunger 36 from retracting its plunger through the respective conductor means until after the actuating signal for the manifold valve 40 is provided through its respective conductor mean to open the manifold valve 40, and for preventing the actuating signal for the manifold valve 42 from opening the valve 42 through the respective conductor means until the actuating signal for the plug release plunger 36 is provided through its respective conductor means to retract the plug release plunger 36.

Figure 7:
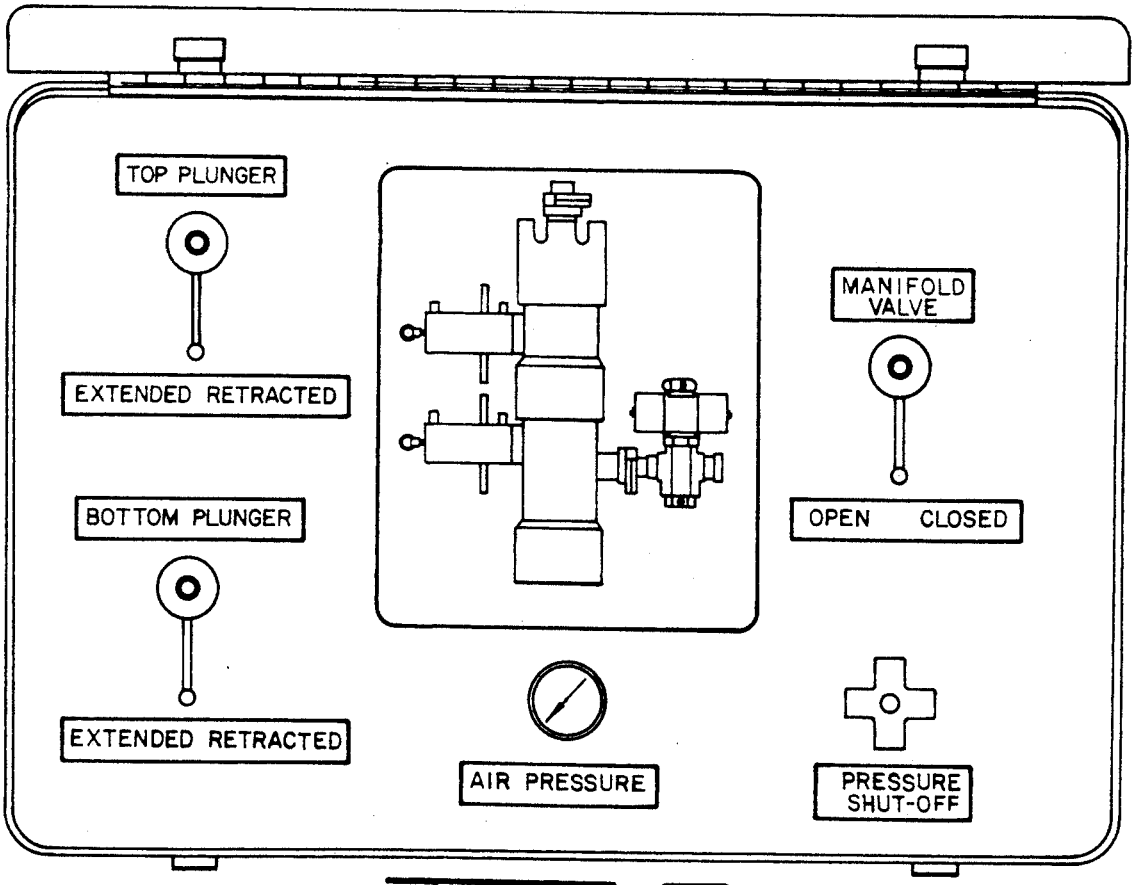
FIG. 7 is an elevational view of a front panel of another embodiment of a remote control console.

Referring next to FIG. 7, a front panel of a control housing of another embodiment is shown. This embodiment is for a pair of stacked single plug containers with a single fluid inlet. In this embodiment only the two plug release plungers need to be sequenced. This can be implemented by using only valves and connections corresponding to the valves 142, 148, 152 of FIG. 6. That is, the valve 142 would control the bottom plug release plunger of the FIG. 7 embodiment, and the valve 148 would control the top plug release plunger of the FIG. 7 embodiment. Sequencing would be controlled by a sequencing valve corresponding to the sequencing valve 152. A sequencing means of the FIG. 7 embodiment would thus prevent or disable the top plug release plunger from being retracted until a selected time after a first selected time at which the bottom release plug plunger was retracted. Thus, it is apparent that other types of sequencing arrangements are encompassed within the present invention.

Other feature which have been contemplated to be included in a system as described hereinabove include the provision of a locking feature on the plug release plungers that will lock the retaining arm in its retracted position. Additionally, panel lights indicating the passage of a plug in response to internal switches or other mechanisms within the plug container 20 being activated could be used. Panel lights could also be connected to illuminate when the plug release plungers are actuated or when the manifold valves are actuated.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for preventing two plugs in a plug container from being released from the container except in a predetermined sequence, said apparatus comprising:

first release means for activating, at a first selected time, the release of the plug predetermined to be released first;

second release means for activating the release of the other plug at a second selected time; and sequencing means, connected to said first and second release means, for disabling said second release means from activating the release of the other plug unless said second selected time is after said first selected time.

2. An apparatus as defined in claim 1, wherein said sequencing means includes a valve including: actuating ports connected to said first release means, and a flow port connected to said second release means.

3. An apparatus as defined in claim 1, wherein:

said apparatus further comprises manifold valve actuating means for actuating a manifold valve connected to the plug container;

said sequencing means includes:

a first valve, including a first valve actuating port connected to said first release means, and a first valve inlet port connected to said manifold valve actuating means, and a first valve outlet port, wherein said first valve is responsive to said first release means so that said first valve inlet port communicates with said first valve outlet port only after said first selected time; and a second valve, including a second valve actuation port connected to said first valve outlet port, and a second valve inlet port connected to said second release means, and a second valve outlet port, wherein said second valve is responsive to said manifold valve actuating means through said first valve so that said second valve inlet port communicates with said second valve outlet port only after both said first selected time and a time at which said manifold valve actuating means opens the manifold valve.

4. An apparatus as defined in claim 3, wherein said sequencing means further includes a check valve including an inlet connected to said first valve outlet port, and an outlet connected to said first valve inlet port.

5. A sequential remote control plug release system, comprising:

plug container having a chamber for receiving two cementing plugs;

a first plug release plunger, connected to said plug container so that said first plug release plunger can be extended into said chamber to support a lower cementing plug received in said chamber and further so that said first plug release plunger can be retracted out of said chamber to allow the lower cementing plug to drop;

a second plug release plunger, connected to said plug container so that said second plug release plunger can be extended into said chamber to support an upper cementing plug received in said chamber and further so that said second plug release plunger can be retracted out of said chamber to allow the upper cementing plug to drop;

a first manifold valve connected to said plug container below said first plug release plunger;

second manifold valve connected to said plug container in between said first and second plug release plungers;

a third manifold valve connected to said plug container above said second plug release plunger;

remote control means, adapted to be operated at a location spaced remotely from said plug container, for controlling the retracting of said first and second plug release plungers and the opening of said first, second and third manifold valves, said remote control means including:

first valve means for providing an actuating signal for said first manifold valve;

second valve means for providing an actuating signal for said first plug release plunger;

third valve means for providing an actuating signal for said second manifold valve;

fourth valve means for providing an actuating signal for said second plug release plunger;

fifth valve means for providing an actuating signal for said third manifold valve;

first conductor means for conducting said actuating signal for said first manifold valve to said first manifold valve;

second conductor means for conducting said actuating signal for said first plug release plunger to said first plug release plunger;

third conductor means for conducting said actuating signal for said second manifold valve to said second manifold valve;

fourth conductor means for conducting said actuating signal for said second plug release plunger to said second plug release plunger;

fifth conductor means for conducting said actuating signal for said third manifold valve to said third manifold valve; and sequencing means, connected to said second, third, fourth and fifth valve means and said second, third, fourth and fifth conductor means, for preventing said actuating signal for said second manifold valve from opening said second manifold valve through said third conductor means until after said actuating signal for said first plug release plunger is provided through said second conductor means to retract said first plug release plunger, and for preventing said actuating signal for said second plug release plunger from retracting said second plug release plunger through said fourth conductor means until after said actuating signal for said second manifold valve is provided through said third conductor means to open said second manifold valve, and for preventing said actuating signal for said third manifold valve from opening said third manifold valve through said fifth conductor means until after said actuating signal for said second plug release plunger is provided through said fourth conductor means to retract said second plug release plunger.

6. A plug release system as defined in claim 5, wherein:

said first conductor means includes a first pair of fluid conductive hoses having a first pair of ends connected to said first valve means and having a second pair of ends connected to said first manifold valve;

said second conductor means includes a second pair of fluid conductive hoses, having a first pair of ends connected to said second valve means and having a second pair of ends connected to said first plug release plunger;

said third conductor means includes a third pair of fluid conductive hoses, having a first pair of ends connected to said third valve means and said sequencing means and having a second pair of ends connected to said second manifold valve;

said fourth conductor means includes a fourth pair of fluid conductive hoses, having a first pair of ends connected to said fourth valve means and said sequencing means and having a second pair of ends connected to said second plug release plunger; and said fifth conductor means includes a fifth pair of fluid conductive hoses, having a first pair of ends connected to said fifth valve means and said sequencing means and having a second pair of ends connected to said third manifold valve.

7. A plug release system as defined in claim 6, wherein each of said first pairs of ends has a different respective spacing between the ends thereof.

8. A plug release system as defined in claim 5, wherein:

said remote control means further includes a housing having disposed therein said first, second, third, fourth and fifth valve means and said sequencing means;

said first conductor means includes a first pair of connectors mounted on said housing a first distance apart;

said second conductor means includes a second pair of connectors mounted on said housing a second distance apart;

said third conductor means includes a third pair of connectors mounted on said housing a third distance apart;

said fourth conductor means includes a fourth pair of connectors mounted on said housing a fourth distance apart;

said fifth conductor means includes a fifth pair of connectors mounted on said housing a fifth distance apart; and each of said first, second, third, fourth and fifth distances is different.

9. A plug release system as defined in claim 8, wherein each of said first, second, third, fourth and fifth conductor means further includes a respective pair of hoses having a pair of end couplings keyed to the spacing of the respective one of said first, second, third, fourth and fifth connectors.

10. A plug release system as defined in claim 5, wherein said sequencing means includes means for enabling said actuating signals for said second and third manifold valves to be provided thereto through said third and fifth conductor means, respectively, for closing said second and third manifold valves.

11. A plug release system as defined in claim 5, wherein:

each of said second and fourth valve means includes respective inlet, exhaust, extend and retract ports;

each of said first, third and fifth valve means includes respective inlet, exhaust, open and close ports;

said sequencing means includes first, second and third sequencing valves, each of said sequencing valves including respective inlet, outlet, exhaust, first drive and second drive ports;

said open and close ports of said first valve means are connected to said first conductor means;

said extend and retract ports of said second valve means are connected to said second conductor means, said extend port of said second valve means also connected to said first drive ports of said first and second sequencing valves, and said retract port of said second valve means also connected to said second drive port of said first sequencing valve;

said close port of said third valve means is connected to said third conductor means, and said open port of said third valve means is connected to said inlet port of said first sequencing valve;

said outlet port of said first sequencing valve is connected to said third conductor means and to said second drive port of said second sequencing valve;

said extend port of said fourth valve means is connected to said fourth conductor means and to said first drive port of said third sequencing valve, and said retract port of said fourth valve means is connected to said inlet of said second sequencing valve;

said outlet of said second sequencing valve is connected to said fourth conductor means and to said second drive port of said third sequencing valve;

said close port of said fifth valve means is connected to said fifth conductor means, and said open port of said fifth valve means is connected to said inlet port of said third sequencing valve; and said outlet port of said third sequencing valve is connected to said fifth conductor means.

12. A plug release system as defined in claim 11, wherein said sequencing means further includes respective check valves connected to said inlet and outlet ports of each of said first, second and third sequencing valves.

13. A plug release system as defined in claim 12, wherein:

said remote control means further includes a housing having disposed therein said first, second, third, fourth and fifth valve means and said sequencing means;

said first conductor means includes a first pair of connectors mounted on said housing a first distance apart, one connector of said first pair connected to said close port of said first valve means and the other connector of said first pair connected to said open port of said first valve means;

said second conductor means includes a second pair of connectors mounted on said housing a second distance apart, one connector of said second pair connected to said extend port of said second valve means and the other connector of said second pair connected to said retract port of said second valve means;

said third conductor means includes a third pair of connectors mounted on said housing a third distance apart, one connector of said third pair connected to said close port of said third valve means and the other connector of said third pair connected to said outlet port of said first sequencing valve;

said fourth conductor means includes a fourth pair of connectors mounted on said housing a fourth distance apart, one connector of said fourth pair connected to said extend port of said fourth valve means and the other connector of said fourth pair connected to said outlet port of said second sequencing valve; and said fifth conductor means includes a fifth pair of connectors mounted on said housing a fifth distance apart, one connector of said fifth pair connected to said close port of said fifth valve means and the other connector of said fifth pair connected to said outlet port of said third sequencing valve; and each of said first, second, third, fourth and fifth distances is different.

14. A plug release system as defined in claim 13, wherein each of said first, second, third, fourth and fifth conductor means further includes a respective pair of hoses having a pair of end couplings keyed to the spacing of the respective one of said first, second, third, fourth and fifth connectors.

15. A method for controlling the use of a plug container connected to a well during a cementing job, which plug container includes two stacked plugs and two fluid inlet valves, said method comprising:

releasing the lower plug into the well;

completing a first control signal circuit in response to releasing the lower plug into the well;

opening one of the two fluid inlet valves, including sending a control signal through the completed first control signal circuit;

completing a second control signal circuit in response to sending a control signal through the completed first control signal circuit, releasing the upper plug into the well, including sending a control signal through the completed second control signal circuit;

completing a third control signal circuit in response to sending a control signal through the completed second control signal circuit; and opening the other fluid inlet valve, including sending a control signal through the completed third control signal circuit.

16. A method as defined in claim 15, further comprising maintaining completed control signal circuits through which control signals for closing the fluid inlet valves can be sent at any time.

* * * * *